US006934506B1

(12) United States Patent
Collaco

(10) Patent No.: US 6,934,506 B1
(45) Date of Patent: Aug. 23, 2005

(54) ACCESSORY FOR RECYCLING PAPER

(76) Inventor: Robert S. Collaco, 87 Village Greenway, Toronto, Ontario (CA) M2J 1K9

( * ) Notice: Subject to any disclaimer, the term of this patent is extended or adjusted under 35 U.S.C. 154(b) by 0 days.

(21) Appl. No.: 10/854,469

(22) Filed: May 27, 2004

(51) Int. Cl.[7] ..... G03G 15/00
(52) U.S. Cl. ..... 399/405; 399/407
(58) Field of Search ..... 399/405, 407, 399/411; 428/903.3, 543; 283/117; 400/717, 400/719, 646, 647, 71

(56) References Cited

U.S. PATENT DOCUMENTS

| | | | | | |
|---|---|---|---|---|---|
| 3,321,130 | A | * | 5/1967 | Cleghorn | 232/43.2 |
| 3,860,309 | A | * | 1/1975 | Brendgord | 312/351 |
| 3,907,281 | A | * | 9/1975 | McKenzie | 271/219 |
| 4,015,714 | A | * | 4/1977 | Silver et al. | 206/511 |
| D246,822 | S | | 1/1978 | Stoufer | D34/8 |
| 4,257,300 | A | | 3/1981 | Muzik | 83/620 |
| 4,481,528 | A | | 11/1984 | Peck | 358/502 |
| 4,645,701 | A | | 2/1987 | Zarrow | 428/120 |
| 4,682,699 | A | * | 7/1987 | Ertley | 211/85.19 |
| 5,111,958 | A | * | 5/1992 | Witthoeft | 220/524 |
| D329,516 | S | | 9/1992 | Bailly | D34/5 |
| 5,150,807 | A | * | 9/1992 | Seyfried et al. | 399/106 |
| 5,208,132 | A | | 5/1993 | Kamada et al. | 430/138 |
| 5,213,141 | A | | 5/1993 | Dorman | 141/10 |
| 5,253,757 | A | * | 10/1993 | Locker | 206/449 |
| 5,332,210 | A | * | 7/1994 | Silverberg et al. | 271/220 |
| 5,662,235 | A | * | 9/1997 | Nieto | 220/23.86 |
| 5,889,544 | A | | 3/1999 | Mey et al. | 347/12.2 |
| 5,927,518 | A | * | 7/1999 | Sidwell | 211/85.29 |
| 6,076,694 | A | * | 6/2000 | Ragot | 220/23.83 |
| 6,572,293 | B1 | * | 6/2003 | Motamed | 400/647 |

* cited by examiner

*Primary Examiner*—Anthony H. Nguyen
(74) *Attorney, Agent, or Firm*—Donald R. Schoonover

(57) ABSTRACT

An accessory for recycling paper receives paper, such as from a copy machine, marks that paper, and stores the marked paper for re-use and/or recycling.

2 Claims, 1 Drawing Sheet

ACCESSORY FOR RECYCLING PAPER

BACKGROUND OF THE INVENTION

1. Field of the Invention

The present invention relates to the general art of salvaging and recycling, and to the particular field of accessories for recycling paper.

2. Discussion of the Related Art

Many businesses and individuals are trying to conserve various items in order to protect the environment. Water is being conserved, fuel is being conserved, and the like.

Furthermore, many people wish to recycle items that can be recycled for re-use. Paper is a particularly visible item that can be re-used if recycled. The paper can be recast as new paper or applied for other uses.

Therefore, there is a need for a means for assisting people in recycling paper.

Copiers are used in nearly every office. Often, people make extra copies or make copies that have errors or the like. Such copies are often simply discarded which is wasteful. If such copies could be re-used, a great savings for both the business and the environment would result.

Therefore, there is a need for a means for assisting people in recycling paper, such as in association with a copier.

However, in order to be most effective, the recycling system should be convenient and easy to use. Otherwise, busy people may not take the time or put forth the effort to use the recycling system.

Therefore, there is a need for a means for assisting people in recycling paper, such as in association with a copier, which is easy and convenient to use.

PRINCIPAL OBJECTS OF THE INVENTION

It is a main object of the present invention to provide a means for assisting people in recycling paper.

It is another object of the present invention to provide a means for assisting people in recycling paper, such as in association with a copier.

It is another object of the present invention to provide a means for assisting people in recycling paper, such as in association with a copier, which is easy and convenient to use.

SUMMARY OF THE INVENTION

These, and other, objects are achieved by an accessory that may be attached to a copier in a convenient location and into which copies that otherwise would be discarded will be placed. The accessory can include some means for marking the paper on the used side.

Using the accessory embodying the present invention will permit a person to place copied paper into a conveniently located collection element so the paper can be re-used. The copied side of the paper can be marked so future uses of the paper will on the opposite side of the paper.

BRIEF DESCRIPTION OF THE DRAWING FIGURES

DETAILED DESCRIPTION OF THE PREFERRED EMBODIMENT

Other objects, features and advantages of the invention will become apparent from a consideration of the following detailed description and the accompanying drawings.

Referring to the Figures, it can be understood that the present invention is embodied in an accessory 10, such as in association with a copy machine M, to receive and store paper that can be re-used and/or recycled. The first section can be translucent so the copying process can be observed.

Figure 2:
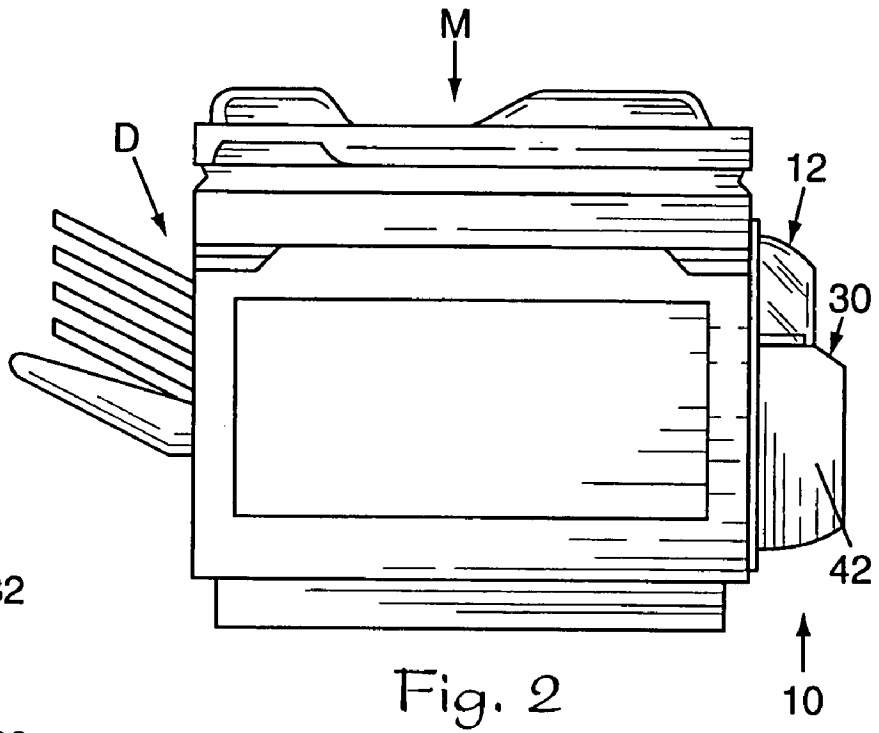
FIG. 2 is a front elevational view of a copier having the accessory embodying the present invention attached thereto.
Figure 1:
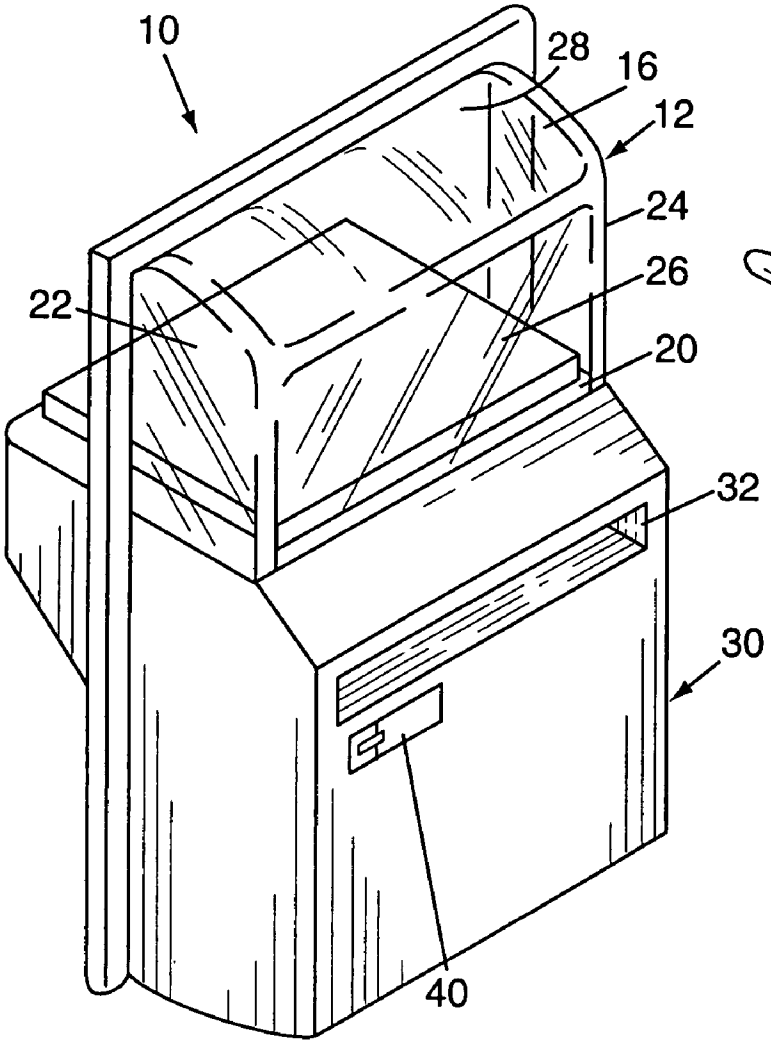
FIG. 1 is a perspective view of an accessory for recycling embodying the present invention.

Accessory 10 comprises a first section 12 that is adapted to be mounted on copy machine M adjacent to one side of the copy machine. Paper from the copy machine is discharged at location D. First section 12 has a first side 16 which is a top side when the first section 12 is in place on the copy machine as shown in FIG. 2. First section 12 further includes a second side 20 which is a bottom side when the first section 12 is in place on the copy machine, a first end 22, a second end 24 and a first face 26, which is a front face when the first section 12 is in place on the copy machine. A second face area 28 of the accessory 10 is open and is located adjacent to the copy machine.

Accessory 10 further includes a second section 30 that is connected to the first section 12. Second section 30 includes a feed section 32 through which paper that would otherwise be discharged is fed into the second section 30 for storage in the second section 30. Second section 30 further includes means 40 for marking the paper passing through the feed section 32 with the marking being placed on the side of the paper that has indicia made during the copying process. Second section 30 has a hollow interior 42 in which marked paper is stored.

It is understood that while certain forms of the present invention have been illustrated and described herein, it is not to be limited to the specific forms or arrangements of parts described and shown.

What is needed and desired to be covered by Letters Patent is as follows:

1. An accessory for recycling paper, comprising:

a) a first section that is adapted to be mounted on a copy machine adjacent to one side of the copy machine, said first section having (1) a first side which is a top side when said first section is in place on the copy machine, (2) a second side which is a bottom side when said first section is in place on the copy machine, (3) a first end, (4) a second end, (5) a first face which is a front face when said first section is in place on the copy machine, and (6) a second face area which is open and which is located adjacent to the copy machine; and b) a second section that is connected to said first section and which includes a feed section through which paper can be passed, said second section having means for marking the paper passing through the feed section, said second section having a hollow interior in which marked paper is stored.

2. The accessory as described in claim 1 wherein said first section is translucent.

* * * * *